United States Patent [19]

Weller et al.

[11] Patent Number: 4,936,697

[45] Date of Patent: Jun. 26, 1990

[54] IMPACT PRINTER PLATEN SUPPORT

[75] Inventors: Ivor Weller, Castro Valley; Helmut K. Waibel, Fremont, both of Calif.

[73] Assignee: Xerox Corporation, Stamford, Conn.

[21] Appl. No.: 250,799

[22] Filed: Sep. 28, 1988

[51] Int. Cl.[5] ..... B41J 11/04

[52] U.S. Cl. ..... 400/660.2; 400/144.2

[58] Field of Search ..... 400/659, 660, 660.2, 400/144.2, 144.3, 167, 636, 636.2, 636.3, 637, 637.1, 637.2, 637.3, 637.4, 637.5, 637.6, 660.1; 101/212

[56] References Cited

U.S. PATENT DOCUMENTS

| | | | |
|---|---|---|---|
| 3,154,184 | 10/1964 | Gallant et al. | 400/660.2 |
| 3,342,299 | 9/1967 | Harmon et al. | 400/660.1 |
| 4,668,112 | 5/1987 | Gabor et al. | 400/387 |

FOREIGN PATENT DOCUMENTS

| | | | |
|---|---|---|---|
| 0222369 | 12/1984 | Japan | 400/660 |

*Primary Examiner*—Edgar S. Burr
*Assistant Examiner*—Joseph R. Keating
*Attorney, Agent, or Firm*—Serge Abend

[57] ABSTRACT

In a serial impact printer including a platen for supporting an image receptor, the platen having a central shaft and a cylindrical impact absorbing sleeve secured thereto, a platen mounting arrangement is provided which is capable of withstanding rapidly repeating, long duration, high impact loads without generating extraneous noise. The ends of the shaft are captured in seats capable of withstanding, without distortion, a high impact printing force in the impacting direction, and are retained in the seats by spring biased arms which restrain the ends of said shaft from rebound movement in a second direction substantially opposite to the impacting direction.

5 Claims, 3 Drawing Sheets

IMPACT PRINTER PLATEN SUPPORT

FIELD OF THE INVENTION

This invention relates to a serial impact printer and, more particularly, to a platen support arrangement capable of withstanding rapidly repeating, long duration, high impact loads without generating extraneous noise.

BACKGROUND OF THE INVENTION

The office has, for many years, been a stressful environment due, in part, to the large number of objectionable noise generators, such as typewriters, high speed impact printers, paper shredders, and other office machinery. Where several such devices are placed together in a single room, the cumulative noise pollution may even be hazardous to the health and well being of its occupants. The situation is well recognized and has been addressed by governmental bodies who have set standards for maximum acceptable noise levels in office environments. Attempts have been made by the technical community to reduce the noise pollution. Some of these methods include enclosing impact printers in sound attenuating covers, designing impact printers in which the impact noise is reduced, and designing quieter printers based on non-impact technologies such as ink jet and thermal transfer.

Noise measurements are often referenced as dBA values. The "A" scale, by which the sound values have been identified, represents humanly perceived levels of loudness as opposed to absolute values of sound intensity. When considering sound energy represented in dB (or dBA) units, it should be borne in mind that the scale is logarithmic and that a 10 dB difference means a factor of 10, a 20 dB difference means a factor of 100, 30 dB a factor of 1000, and so on.

Typically, impact printers generate impact noise in the range of 65 to just over 80 dBA, which is deemed to be intrusive. When reduced to the high 50s dBA, the noise is construed to be objectionable or annoying. It would be highly desirable to reduce the impact noise to a dBA value in the vicinity of 50 dBA. For example, the IBM Selectric ball unit typewriters generate about 78 dBA, while the Xerox Memorywriter typewriters generate about 68 dBA. The typewriter of the present invention has been typically measured at slightly less than 52 dBA. This represents a dramatic improvement on the order of about 100 times less noisy than present day offices, a notable achievement toward a less stressful office environment.

Although the printing impact, produced as the hammer impacts and drives the type character pad against the ribbon, the print sheet and the platen with sufficient force to release the ink from the ribbon, is the major source of noise in the typewriter, other noise sources are present. In the presently available typewriters, the impact noise overshadows the other noises. But, once the impact noise has been substantially reduced, the other noises will no longer be extraneous. Thus, the design of a truly quiet printer requires the designer to address reducing all other noise sources, such as those arising from platen vibration, carriage motion, character selection, ribbon lift and advance, as well as from miscellaneous clutches, solenoids, motors and switches.

In conventional ballistic hammer impact printers a hammer mass of about 2.5 grams is driven ballistically by a solenoid-actuated clapper toward the ribbon/paper/platen combination. When the hammer hits the rear surface of the character pad it drives it against the ribbon/paper/platen combination and deforms the platen surface which, when it has absorbed the hammer impact energy, seeks to return to its normal shape by driving the hammer back to its home position where it must be stopped, usually by another impact. This series of impacts is the main source of the objectionable impact noise.

Looking solely at the platen deformation impact portion of the hammer movement, the total dwell time is typically in the vicinity of 100 microseconds. At a printing speed of 30 characters per second, the mean time available between character impacts is about 30 milliseconds. The impact noise reduction achieved by the printing mechanism of the present typewriter is made possible by significantly stretching the impact dwell time to a substantially larger fraction of the printing cycle than is typical in conventional printers. For instance, if the dwell time were stretched from 100 microseconds to 6 to 10 milliseconds, this would represent a sixty- to one hundred-fold increase, or stretch, in pulse width relative to the conventional. By extending the deforming of the platen over a longer period of time, the resonant frequency is proportionally decreased and an attendant reduction in noise output can be achieved. In a resonant system, since the mass is inversely proportional to the inverse of the frequency shift, a massive increase in hammer mass is required.

The general concept implemented in the present typewriter, i.e. reduction of impulse noise achieved by stretching the deformation pulse, has been recognized for many decades. As long ago as 1918, in U.S. Pat. No. 1,261,751 (Anderson) it was recognized that quieter operation of the printing function in a typewriter may be achieved by increasing the "time actually used in making the impression". A type bar typewriter operating upon the principles described in this patent was commercially available at that time.

RELATED PATENTS AND PRIOR ART

The quiet impact printing mechanism incorporating the present invention is described, and its theory of operation is explained in the following commonly assigned patents any one of whose disclosures is herein fully incorporated by reference. U.S. Pat. No. 4,668,112 (Gabor et al), entitled "Quiet Impact Printer", relates to the manner in which the impact force in a printer of this type is controlled; U.S. Pat. No. 4,673,305 (Crystal), entitled "Printwheel For Use in a Serial Printer", relates to a printwheel modified for quiet operation when used with an alignment member; U.S. Pat. No. 4,678,355 (Gabor et al) entitled "Print Tip Contact Sensor for Quiet Compact Printer", relates to an impacting element having a sensor thereon for signaling initiation of impact; U.S. Pat. No. 4,681,469 (Gabor), entitled "Quiet Impact Printer", relates to the high mass, prolonged contact period, parameters of a printer of this type; U.S. Pat. No. 4,686,900 (Crystal et al), entitled "Impact Printer With Application of Oblique Print Force", relates to a shear inducing impacting element; and U.S. Pat. No. 4,737,043 (Gabor et al), entitled "Impact Mechanism for Quiet Impact Printer", relates to a unique prime mover and high mass print tip driver.

It will become apparent from a review of the above-identified, commonly assigned, patents that a character impacting member, having a high effective mass, is driven with a first force, from a starting position to the rear of a character element and then continues forward, together with the character imprinting element, which picks up the marking (or correcting) ribbon, across a throat gap into incipient contact with the platen/paper combination. A second force, of a magnitude sufficient to release the marking material and deform the platen, is applied as soon as the control microprocessor receives a signal that contact has been made with the platen. The second force, having a magnitude of about 40 pounds and a duration of about 10 milliseconds, would overload conventional platen mounting arrangements which usually comprise seats formed in the sheet metal side walls, probably causing deformation of the side walls and rendering the printer useless. Furthermore, the conventional seats would not restrain the substantial rebound of the platen which would vibrate and generate noise.

Therefore, it is the primary object of the present invention to provide a platen support implementation which will hold the platen in place in seats capable of sustaining the massive, long duration, imprinting force and retain its dimensional integrity and which will retain the platen shaft within its supporting seats during platen flexures, so as to prevent noise caused by unrestrained vibration.

It is a further object of this invention to provide a platen support arrangement which prevents lateral platen vibration and lateral platen creep.

SUMMARY OF THE INVENTION

The present invention may be carried out, in one form, by providing a serial impact printer comprising a platen for supporting an image receptor, the platen including a central support shaft and a cylindrical impact absorbing sleeve secured thereto, a print element having character imprinting portions disposed thereon, a print element selector for moving said print element to position a selected character imprinting portion at a printing position, a marking ribbon positionable between the print element and the platen, and means for delivering a force to the character imprinting portion so as to drive it against the platen. The force delivering means has an effective mass of at least 0.5 pounds and deforms said platen for a contact period of at least 1 millisecond. The ends of the platen shaft are captured by a mechanism including first means for withstanding, without distortion, the impact printing force, in a first direction, and second means for retaining the ends of the shaft in contact with the first means with a force sufficient to overcome rebound movement of the ends of the shaft in a second direction substantially opposite to said first direction.

BRIEF DESCRIPTION OF THE DRAWINGS

Other objects and further features and advantages of this invention will be apparent from the following, more particular description considered together with the accompanying drawings, wherein.

DETAILED DESCRIPTION OF THE ILLUSTRATED EMBODIMENT

Figure 1:
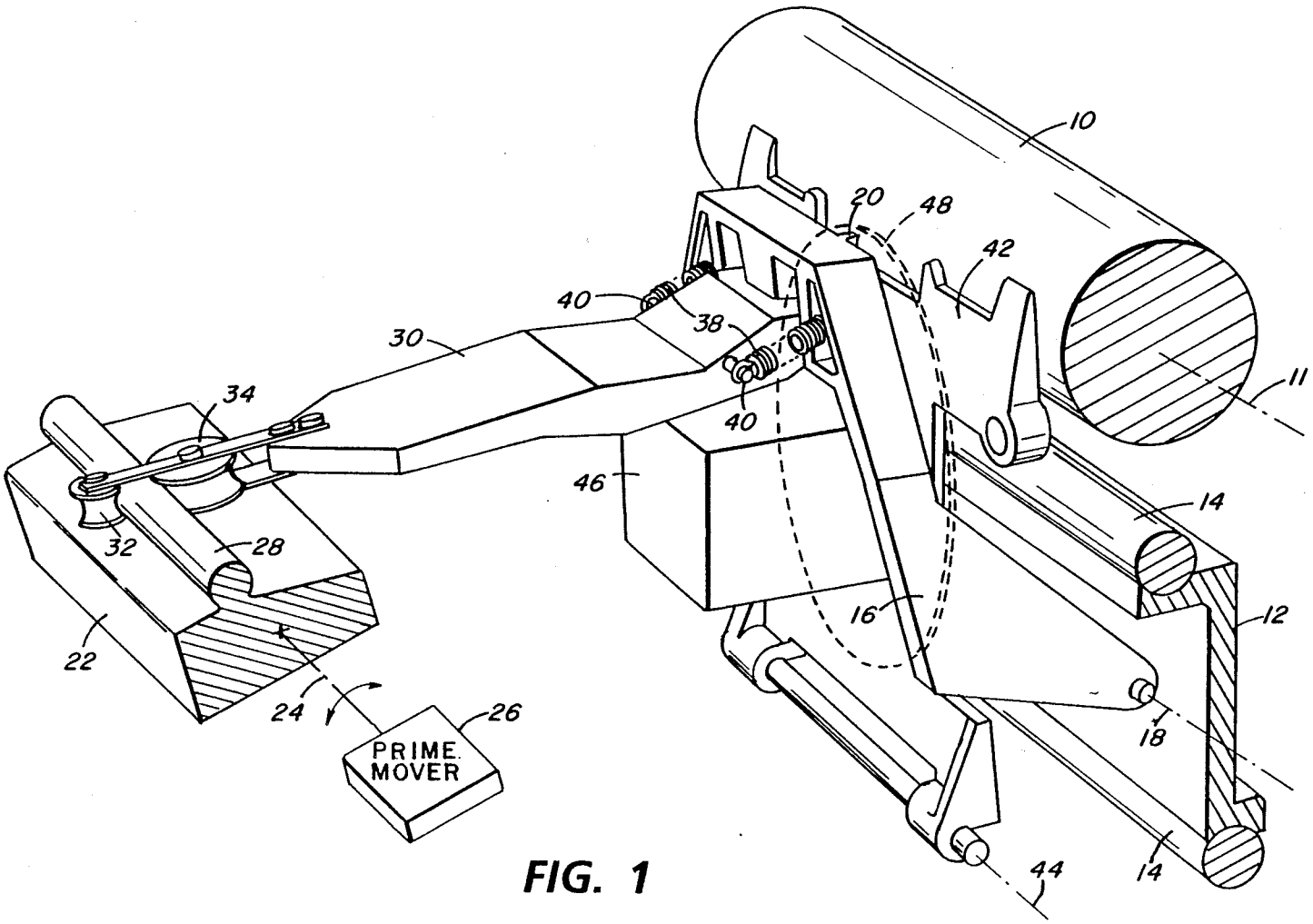
FIG. 1 is a partial perspective view schematically showing the relevant features of a quiet impact printer in which the present invention may be incorporated.

Salient features of the quiet impact printer, in which the present invention is incorporated, are shown in FIG. 1. These include a platen 10 suitably mounted on a frame (not shown) for rotation about its axis 11 to advance and retract a record carrier, comprising a single sheet or a multi-part form, on which characters may be imprinted. A carriage support beam 12, integral with a body casting (not shown), fitted with rod stock rails 14, spans the printer from side-to-side beneath and parallel to the platen for rigidly and smoothly supporting a carriage for traversing movement parallel to the axis of the platen. Secured upon the carriage, for traversing movement therewith, is a horseshoe-shaped interposer 16 mounted for arcuate movement about pivot axis 18 and carrying a print tip 20 at its apex.

A rockable bail bar 22 extends substantially parallel to the axis of platen 10 and is constrained to limited angular movement toward and away from the platen about its axis of rotation 24. Prime mover 26, in the form of a reciprocating voice coil motor, a rotary motor, or any other suitable driver, is connected to the bail bar for imparting the rocking movement thereto. A bead or rail 28 on the bail bar receives one end of push rod 30, via a pair of capturing rollers 32 and 34, for moving it toward and away from the platen as the bail bar is rocked. The non-collapsible push rod, as illustrated, is a generic form of this element which is collapsible in its commercial form for allowing the print tip 20 to be drawn back away from the platen in order to allow the operator easy access to a printwheel. A bearing surface (not shown) on the opposite end of the push rod is biased into engagement with a seat on the rear wall of the print tip 20 by means of tension springs 38 extending between pins 40 on the push rod and suitable anchors on the interposer 16. The drive force of the prime mover 26 is multipled by the bail bar 22 and is translated to the print tip 20 by the push rod 30 which may pivot about bearing surface, so as to enable it to follow the arcuate path of the print tip, prescribed by the pivoting interposer 16. Thus, the print tip delivers the approximately forty pound impact force, having a duration of about 10 milliseconds, to the platen at an oblique angle in the range of about 15° to 40°.

Pivot frame 42 is also mounted upon the carriage for pivoting movement toward and away from the platen in an arcuate path about pivot axis 44. A printwheel drive motor 46, having a drive shaft terminating in a coupling member (not shown), is secured to the pivot frame for movement therewith. When the operator drops a printwheel 48 into the printer, it is captured between a retaining member and the coupling member and moves together with the pivot frame.

Figure 2:
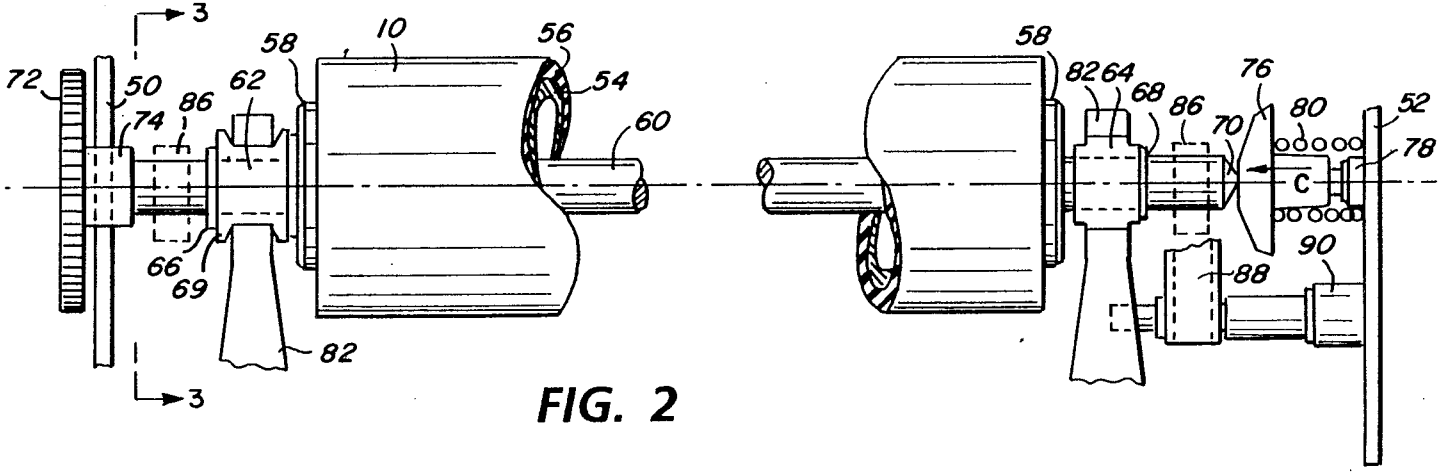
FIG. 2 is a partial elevation view showing the platen mounting arrangement.
Figure 3A:
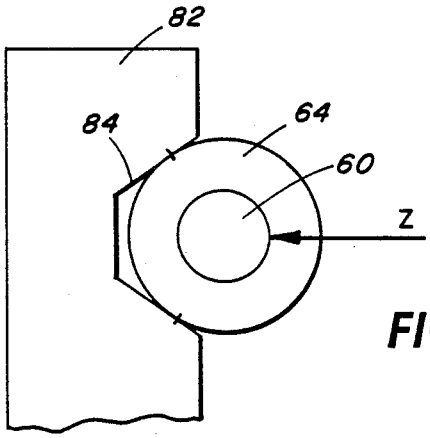
FIG. 3*a* is an enlarged schematic view showing the platen support.
Figure 3:
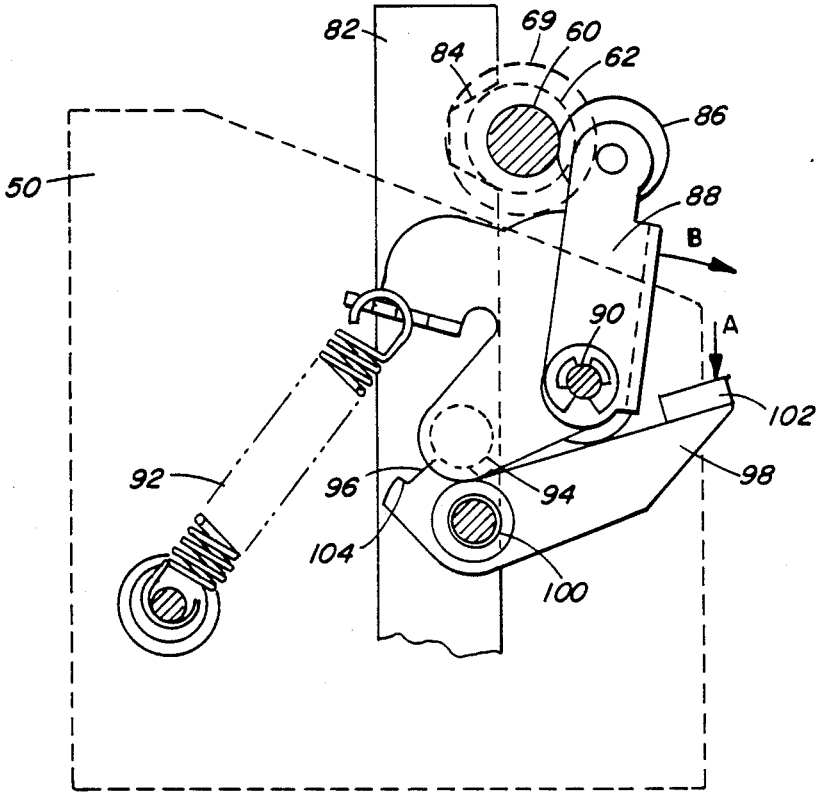
FIG. 3 is a sectional view taken substantially alone line 3—3 of FIG. 2.

Turning to FIGS. 2 and 3, the platen mounting arrangement of the present invention is shown in detail. Platen 10 extends substantially completely between printer side walls 50 and 52, although it is not supported thereon, as is done in conventional printers. The platen utilized in our quiet printer is more rigid than conventional platens in order that it may withstand the high impact forces delivered by the print tip 20. It comprises a central tubular steel body 54 surrounded by a resilient sleeve 56, end caps 58 secured in the body, a platen shaft 60 passing through and secured in the end caps, and bearings 62 and 64 mounted upon the shaft adjacent the end caps and held in place by retainer washers 66 and 68. Bearing 62 is formed with flanges 69. One end 70 of the platen shaft is bullet-shaped and the other end supports a drive coupling gear 72 whose hub 74 is secured to the shaft. The bullet-shaped platen end 70 is axially biased away from side wall 52 by button 76 supported upon side wall mounted stud 78 and biased by compression spring 80.

A body casting, which includes the carriage support beam 12, underlying the platen, has a pair of rigid upright posts 82, one on either end of the platen, each formed with a wedge-shaped saddle 84 for receiving bearings 62 and 64. Each of the platen bearings is urged against its respective saddle by a biasing mechanism as illustrated in FIGS. 3 and 3*a* (portions thereof are also shown in FIG. 2). Each biasing mechanism includes a platen shaft biasing roller 86 pinned for rotation at the upper end of a generally U-shaped sheet metal pivoting plate 88, which in turn is mounted for rotation about stud 90 secured to side wall 52. Heavy-duty tension spring 92 is anchored to the side wall at one end and is secured to the pivoting plate at its other end, so as to urge the biasing roller against the platen shaft 60. At the lower end of the pivoting plate 88 there is mounted a cam follower stud 94 acted upon by the camming surface 96 of pivotable release lever 98, mounted for rotation about pivot pin 100.

In order to release the platen for removal, the operator or repairman must overcome the heavy biasing force of spring 92. By applying a downward spring release force, in the direction of arrow A, against release lever actuating surface 102, the release lever 98 is rotated about pivot pin 100. Camming surface 96 raises cam follower stud 94, to rotate pivoting plate 88 in the direction of arrow B against the force of the tension spring 92. Rotation of the release lever through an angle of about 45° brings the cam seat 104 into position to receive and hold the cam follower stud 94 in an over-center position so that the pivoting plate is arrested in its platen shaft release position. Raising the actuating surface 102 frees the cam follower stud from the cam seat and allows the tension spring 92 to once again urge the pivoting plate in a counterclockwise direction about stud 90, driving the platen shaft biasing roller 86 against the platen shaft 60.

This heavy duty platen mounting arrangement is necessary to withstand the high impact forces applied over the relatively long duration. Both static and dynamic conditions have been taken into consideration in this unique design. The static loading condition is easiest to visualize. A high force of about 40 pounds pushing against the platen must be resisted with a structure capable of withstanding it. To this end we have provided the cast metal standards 82 having saddles formed therein.

Figure 4:
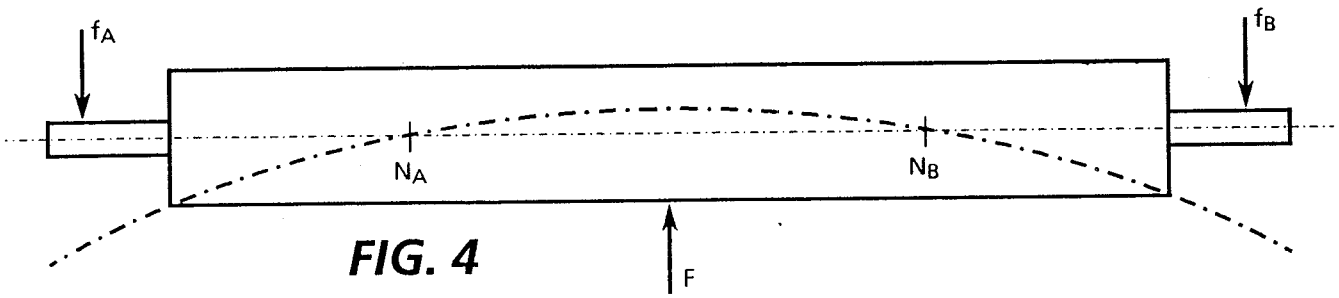
FIG. 4 is a schematic plan view of the platen showing the effect of imprinting forces thereon.

To understand the dynamic loading condition, the illustration of FIG. 4 is referenced. A series of rapidly applied, long duration, high impact forces is delivered to the platen all along its length during serial printing. Consideration will be given to the most extreme condition, wherein the impact forces are rapidly applied in the vicinity of the center of the platen. In this case, when viewed as a free body in space, the platen will be seen to be flexed by the force F at its center and will pivot about (be stationary at) nodes $N_A$ and $N_B$ located about ¼ of the platen length on either side of the center. Under this condition, it can be seen that the ends of the platen will thrust forward with forces $f_A$ and $f_B$ directed oppositely to force F (−F direction). As the impacting element is drawn back by the prime mover, the platen follows it and deforms in the opposite direction until contact is released and then the platen will rebound back in the direction of initial force F. As its vibrations are damped, the platen ends have a tendency to move out of the axial plane toward the front of the printer each time the platen flexes in the direction of force F.

It should be apparent that in order to maintain the platen in its axial plane, rigidity is required both in the F and −F directions, so as to prevent the platen from bouncing in its seats and generating noise. We have accomplished this, in the F direction, with the saddles 84 in the standards 82 of the body casting, and in the −F direction with the outboard platen shaft biasing rollers 86 which push on the shaft with a spring force of about 12 pounds (indicated by arrow Z in FIG. 3*a*). A spring force of a magnitude selected to be adequate for holding the platen shaft ends in the saddles when a force is being applied will be sufficient to hold the ends in place during the rebound flexure.

Another source of noise is the rattle generated between the platen shaft and its bearings 62 and 64. We eliminate that noise, by removing all play between the bearings and the shaft as shown by the three-point support in FIG. 3*a*. By pushing the biasing rollers 86 against the shaft 60, adjacent to and outboard of the saddles 84, we exert a force on the inner diameter of the bearings, which in turn push the outer diameter of the bearing into the saddles. This mounting arrangement also insures that the platen seats itself correctly and will always be accurately positioned.

When the platen is placed in the printer, the bullet end 70 of shaft 60 snaps into a recess (not shown) in the apex of spring biased button 76 for positioning the platen in the correct axial position. As the button pushes the platen shaft in the direction of arrow C it urges the left end cap 58 against the outer surface of flange of bearing 62 surface of the flange against the side wall of post 82 for eliminating noise generating axial play between the bearings and the platen shaft. The spring biased button 76 provides a positive load to the platen in one direction for preventing axial migration thereof, which undermines accurate correction. We have provided the flange 69 on bearing 62 to act as a stop to limit axial movement. Absent the bias load, as the platen is rotated there is a possibility that it will migrate axially under the influence of the cradle rollers beneath the platen (not shown) on which it is seated. If one of the cradle rollers is slightly cocked it would have a tendency to drive the platen in one axial direction when the platen is rotated in one direction and in the opposite axial direction when the platen is oppositely rotated. When the correction command is given, it is likely that the platen will have to back up one or more lines and that there will be a slight displacement between the axial positioning of the printed character and the correcting character. Any such displacement will prevent lift-off of the entire character. Thus, in addition to the noise reducing benefits of the axial loading device, it will also introduce a uniform axial displacement regardless of the direction of platen rotation.

It should be understood that the present disclosure has been made only by way of example and that numerous changes in details of construction and the combination and arrangement of parts may be resorted to without departing from the true spirit and scope of the invention as hereinafter claimed.

What is claimed:

1. A serial impact printer comprising a base over which are disposed a platen for supporting an image receptor, said platen including a central support shaft having ends which are supported, and a cylindrical impact absorbing sleeve secured thereto, a print element having character portions disposed thereon, a print element selector for moving said print element to position a selected character portion at a printing position, a marking ribbon positionable between said print element and said platen, and means for delivering a force to said character portion so as to drive it against said platen, in a first direction with an effective mass of at least 0.5 pounds and an extended contact period of at least 1 millisecond, the improvement comprising, means for capturing said shaft ends as said platen deforms in said first direction and said shaft ends rebound in a second direction, opposite to said first direction, in response to said force being applied to said platen in said first direction, said means for capturing including means for cradling said shaft ends, including a support block extending from said base at each end of said shaft, each of said support blocks having a seat therein opening in said second direction, and resilient means for retaining said shaft ends in contact with said seats with a force directed in said first direction to overcome rebound movement of said shaft ends, said seats in each block are wedge-shaped, said shaft ends support bearings thereon and are rotatable therein and said bearings are held against said wedge-shaped seats by said resilient means which comprises a roller located at each end of said shaft, and means for biasing each of said rollers against said shaft at a location remote from said bearings, said means for biasing acting directly against said shaft and urging said bearings into said wedge-shaped seats while removing clearance from between the bearing portions of said shaft and said bearings for eliminating vibration therebetween.

2. The serial impact printer as defined in claim 1 characterized in that said resilient means comprises a spring biased roller at each end of said shaft, each of said rollers being movable from a first position for capturing said shaft end to a second position for releasing said shaft end.

3. The serial impact printer as defined in claim 1 characterized in that said resilient means comprises a pivotable arm on which said roller is mounted, a spring connected to said arm for urging said arm toward said shaft, and release means for moving said pivotable arm away from said shaft.

4. The serial impact printer as defined in claim 3 characterized in that a cam follower is located on said pivotable arm, and said release means is pivotable and carries a driving cam thereon interacting with said cam follower to move said pivotable arm away from said shaft.

5. The serial impact printer as defined in claim 1 characterized by further including means for eliminating axial play between said shaft and said bearings and axial platen creep, said means for eliminating including means for continuously biasing said shaft in one axial direction.

* * * * *